United States Patent [19]

Back et al.

[11] Patent Number: 4,671,365

[45] Date of Patent: Jun. 9, 1987

[54] DRILL FEEDING AND HOISTING SYSTEM FOR AN EARTHDRILL

[75] Inventors: Carl F. Back, Orrville, Ohio; Ashwin R. Nagawadia, Bangalore, India

[73] Assignee: Ingersoll-Rand Company, Woodcliff Lake, N.J.

[21] Appl. No.: 794,113

[22] Filed: Nov. 1, 1985

[51] Int. Cl.[4] ..... E21B 7/02; E21C 11/02; B66C 23/62

[52] U.S. Cl. ..... 173/28; 173/147; 175/170

[58] Field of Search ..... 173/147, 22–29, 173/163, 141; 175/170, 171, 202; 212/267, 184

[56] References Cited

U.S. PATENT DOCUMENTS

| | | | |
|---|---|---|---|
| 3,572,517 | 3/1971 | Liebherr | 212/184 |
| 4,195,698 | 4/1980 | Nakagawasai | 173/147 X |
| 4,371,041 | 2/1983 | Becker et al. | 173/147 X |
| 4,394,914 | 7/1983 | Privat | 212/184 X |

*Primary Examiner*—E. R. Kazenske
*Assistant Examiner*—John L. Knoble
*Attorney, Agent, or Firm*—Arthur N. Trausch

[57] ABSTRACT

A compact earthdrilling module for vehicle mounting includes a derrick having a conventional tophead-drive drill assembly slidably mounted thereon. The derrick includes an extendable top portion mounting a hoist. A single telescoping piston-cylinder assembly on the derrick moves the drillhead assembly along the derrick and extends the top portion of the derrick. The piston-cylinder assembly is hydraulically actuated.

2 Claims, 3 Drawing Figures

FIG. 1
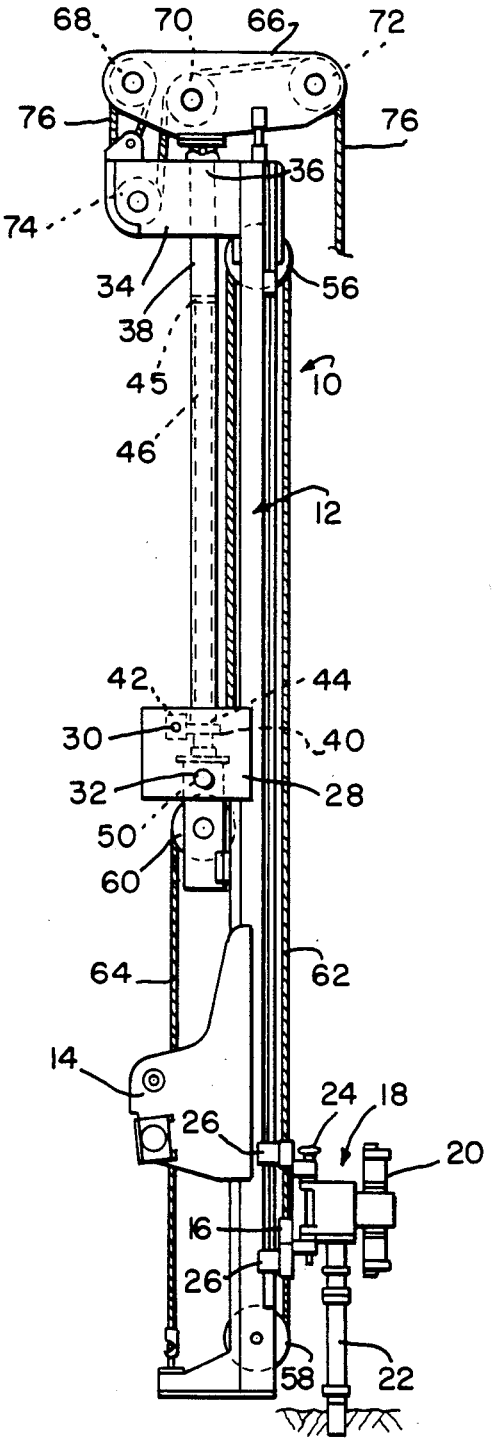
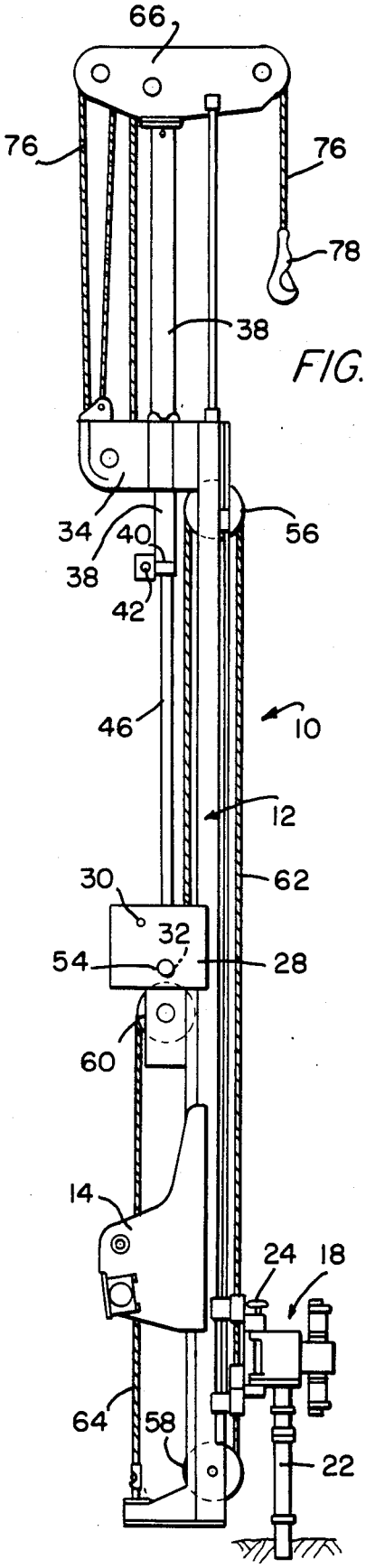
FIG. 3

DRILL FEEDING AND HOISTING SYSTEM FOR AN EARTHDRILL

FIELD OF THE INVENTION

The present invention pertains to a compact earthdrill module wherein the hydraulic system used to provide vertical pulldown and pullback for the tophead-drive drill assembly is also utilized for hoisting.

BACKGROUND OF THE INVENTION

The derrick of a drilling rig is used primarily to support the vertical travel of the tophead-drive drill assembly and secondarily as the tower for hoisting casing and pulling drill pipe. To support the travel of the tophead assembly, the derrick needs only to be tall enough to accommodate a standard section of drill pipe plus any necessary travel clearance for the tophead assembly. Therefore, the derrick needs to be only somewhat longer than a drill pipe which is about 3 meters.

For hoisting purposes, however, a taller derrick is needed to handle casing pipe, which typically is twice the length of drill pipe. A tall derrick is also economically desirable to pull double sections of drill pipe and reduce non-drilling time. Thus, a permanent derrick extension has typically been added to the top of the derrick to provide a tower for hoisting. Furthermore, the actual hoisting is usually provided by an auxiliary winch and power drive system.

Thus known drilling rigs have permanent derrick extensions and additional drive components only to facilitate the hoisting operation. The auxiliary equipment is not needed for the drilling operation. Consequently, drill rigs are heavy and cumbersome. Mobile rigs are awkward to maneuver even when the derrick and extension are in a horizontal transportation position. Additionally, the permanent derrick extension often precludes transporting mobile rigs in standard length shipping containers.

The present invention teaches the use of a telescoping piston-cylinder assembly for hydraulic cable pulldown and pullback that provides precise control for tophead-drive drilling. In the hoisting mode, the telescoping piston-cylinder assembly becomes a hydraulic hoist capable of lifting casing or pulling double sections of drill pipe.

The object of the invention, therefor, is to provide a simple, compact, lightweight, and economical drill rig module.

Primary objects include providing a compact derrick and power feed system and an efficient hoisting system.

Another object includes providing a telescoping piston-cylinder assembly for pulldown that can also be used to extend the derrick for hoisting.

Another object includes providing the precise control afforded by hydraulics to both the pulldown and hoisting systems without redundant drive components.

Further objects include elimination of a permanent derrick extension and the extra power drive components needed only for hoisting without increasing non-drilling time.

These and other objects and advantages are obtained in the power pulldown and pullback and hoisting system described below.

BRIEF DESCRIPTION OF THE DRAWINGS

FIG. 1 is a side view of the drilling rig module according to the invention illustrating the drilling operation in the pulldown mode.

FIG. 3 is a side view similar to FIG. 1 illustrating the hoisting opration with the derrick telescopingly extended.

DETAILED DESCRIPTION OF THE PREFERRED EMBODIMENT

Figure 2:
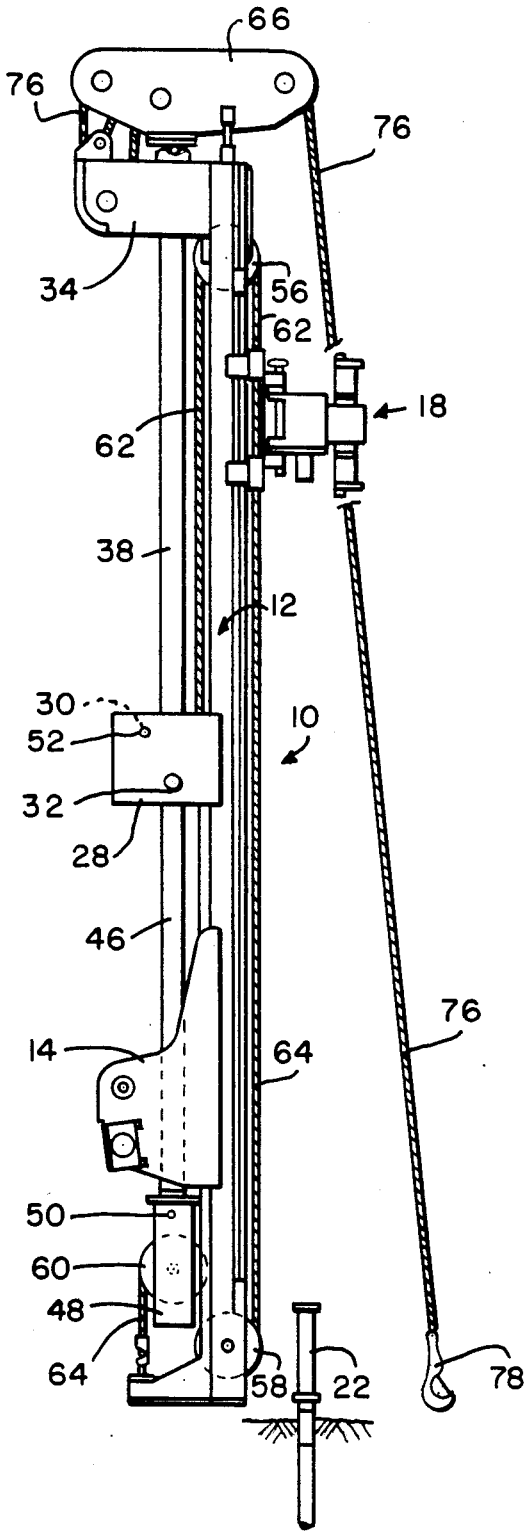
FIG. 2 is a side view fimilar to FIG. 1 illustrating the drilling operation in the pullback mode.

Referring now to the drawings, the drilling rig module 10 includes a derrick 12 supported by a mounting bracket 14. The derrick is constructed of welded and bolted structural members. The mounting bracket is fixed to the lower end of the derrick in such a manner that the derrick can be pivotably mounted to a vehicle (not shown) in a manner well known in the prior art.

The mounting bracket is also adapted for connection to an elevating mechanism (not shown) which is also well known. The derrick can thus be transported in a generally horizontal position and elevated to a vertical position for operation at the drill site.

The derrick slidably supports a movable carriage 16 which carries a tophead-drive drill assembly 18. The tophead assembly includes at least one reversible motor 20, such as a fluid-operated motor for rotary or downhole drilling, and is adapted for continuous connection to a fluid source for all positions on the derrick. The tophead assembly is further adapted for connection to a drill bit or a string of drill pipe 22 for drilling. The tophead assembly is attached to the carriage by a pivot pin 24 so that the tophead assembly may be swung about a vertical axis to a position laterally clear of the drilling axis. The carriage is slidably supported on the derrick by means of bearing guides 26 which are disposed on both sides of the carriage in a conventional manner. The carriage is free to slide longitudinally along the derrick and is guided in that movement by the bearing guides. The guides permit linear movement along the front face of the derrick for a distance great enough to accommodate feeding a drill pipe into the drill hole.

A midpoint bracket 28 is fixed to at least one side of the derrick and projects to the back. The bracket has top and bottom locking holes, 30 and 32 respectively. A top arm 34 is fixed to the derrick near the top and projects away from the back face of the derrick.

A telescoping piston-cylinder assembly is located between the bracket 28 and the arm 34 and is adapted for connected to a fluid source (not shown) for hydraulic actuation in both directions. Preferably a single cylinder 38 is centrally mounted between the derrick sides. The cylinder 38 is filled with fluid and has a closed end 36 and an open end 44. The closed end 36 of the cylinder 38 is slidably held by the top arm 34 of the derrick. A flange member 40 is fixed to the open end 44 of the cylinder and has a locking hole 42 which is offset from the cylinder axis. Locking hole 42 is shown in alignment with locking hole 30 in FIG. 1, and out of alignment in FIG. 3.

A piston 45 is disposed in the fluid-filled cylinder 38. Fluid ports (not shown) admit fluid to opposite sides of the piston so that the piston can act in both directions as is well known in the prior art. Flexible hoses supply fluid to the fluid ports from a pressure source in a continuous manner.

A piston rod 46 extends from the piston 45 (best seen in FIG. 1) and is slidably extendable from the open end 44 of the cylinder. The piston rod has a pulley block member 48 fixed to the extending end. The block member has a locking hole 50 which is positioned along the piston rod axis. Locking hole 50 is shown in alignment with locking hole 32 in FIG. 1 and out of alignment in FIG. 2.

When the piston rod 46 is fully contained within the cylinder 38 as shown in FIG. 1, flange locking hole 42 aligns with the bracket top locking hole 30 and block locking hole 50 aligns with the bracket bottom locking hole 32. A first removable locking pin 52 can be inserted in aligned flange locking hole 42 and bracket locking hole 30 such that cylinder 38 is fixed to the derrick midpoint bracket 28. (See FIG. 2.) A second removable locking pin 54 can be inserted in aligned block locking hole 50 and bracket locking hole 32 such that piston rod 46 is fixed to the derrick midpoint bracket 28. (See FIG. 3.) Note that neither pin 52 or 54 is shown in FIG. 1 to provide a clear view of the locking holes.

In the operation of the drilling rig module, in either the drilling or hoisting mode as will be explained later, one of the locking pins 52 or 54 is removed. (See FIGS. 2 and 3.) Therefore, during operation only one of either the cylinder 38 or the piston rod 46 is anchored to the derrick midpoint bracket 28. Thus, when the piston-cylinder assembly is hydraulically actuated either the unanchored piston rod 46 or unanchored cylinder 38 can be telescopingly extended away from derrick midpoint bracket 28.

An idler pulley 56 is mounted near the top of the derrick and idler pulley 58 is mounted near the base of the derrick. A pulley 60 is mounted in pulley block 48 and is movable with piston rod 46. Pullback cable 62 is fixed to the top of carriage 16, wound around idler pulley 56, around movable pulley 60, and is fixed to midpoint bracket 28. Pulldown cable 64 is fixed to the bottom of carriage 16, wound around idler pulley 58, around movable pulley 60, and is fixed to the base of the derrick. In a manner well known from the prior art, cables 62 and 64 cooperate with idler pulleys 56 and 58 and movable pulley 60 to translate carriage 16 along the derrick, providing pulldown and pullback.

A crown block 66 having back, middle and front sheeves, 68, 70 and 72 respectively, is mounted on the closed end 36 of the cylinder. A sheeve 74 is mounted in the free end of top arm 34. The cylinder 38 slidably extends through top arm 34 and cylinder closed end 36 is fixed to the crown block above the top arm. This permits the crown block to be raised when the cylinder 38 is telescopingly extended. A fixed length hoist cable 76 (best seen in FIG. 2) is fixed to the top arm 34, wound around the back sheeve 68, around the arm sheeve 74, and over middle sheeve 70. The hoist cable passes over front sheeve 72 and ends with hoist hook 78. This arrangement produces a 4:1 motion ratio such that when crown block 66 moves through a unit of distance, hook 78 moves four times the distance in the same direction.

In operation the drilling rig module is transported to the drilling site and the derrick 12 is raised to the vertical position shown in the drawings. The locking pins 52 and 54 are initially locked in their respective aligned holes during transportation and set-up to prevent any movement of the piston-cylinder assembly. To begin the drilling operation, locking pin 54 is removed from the aligned holes in the bracket and piston rod pulley block, as shown in FIG. 2. Thus, the piston rod 46 can move relative to the midpoint bracket while the cylinder 38 remains locked to the bracket by pin 52. As the telescoping piston-cylinder assembly is hydraulically actuated, the piston rod 46 extends downward together with the attached pulley block 48 and pulley 60. This motion results in pullback cable 62 moving the carriage 16 twice the distance in the opposite direction. When the piston rod is fully extended, carriage 16 and tophead assembly 18 has moved twice the rod length and is at the top of the derrick, as shown in FIG. 2. A section of drill pipe can be coupled between the raised tophead assembly 18 and the drill string or drill bit 22 in a conventional manner.

As the telescoping piston-cylinder assembly is hydraulically actuated to move in the opposite direction, that is, to return the piston rod 46 within the cylinder 38, the pulldown cable 64 controllable applies pressure to the tophead assembly 18. The combination of motion provided by the motors 20 and vertical pressure provided by the pulldown system provides drilling momentum for rotary or down-hole drilling, as is well known. Successive drill pipes are added to the drill string in the same manner until the desired well depth is reached.

After drilling is completed, it is desirable to pull the drill string from the well and set casing into the well. First, the tophead assembly 18 is disconnected from the drill string 22, in a conventional manner. The tophead assembly is swung horizontally clear of the drill axis on pivot pin 24 (as shown in phantom in FIG. 3). Locking pin 54 is re-inserted in the aligned locking holes 32 and 50 to anchor piston rod 46 to the midpoint bracket. Locking pin 52 is removed from locking holes 30 and 42 such that cylinder 38 can move relative to the midpoint bracket. Hoist hook 78 is attached to the drill pipe 22 to be pulled from the well or to a casing member (not shown) to be raised and set into the well. When the telescoping piston-cylinder assembly is hydraulically actuated, the cylinder 38 extends upward through the derrick top arm 34, raising the crown block 66. As the crown block moves, hook 78 moves in the same direction at a 4 to 1 motion ratio. When the cylinder 38 is fully extended above the piston rod 46, as shown in FIG. 3 the derrick is extended to the maximum height necessary for hoisting. The hook 78 has been raised high enough to pull a double section of drill pipe from the well. The drill pipe can then be disconnected from the drill string. Alternatively, a section of casing, which typically is twice the length of a drill pipe, can be raised for insertion into the well. The hoist hook can be lowered by an opposite hydraulic actuation.

It should be understood that the above described invention eliminates the permanent derrick extension while still providing fast and economic removal of drill pipe and handling of longer casing. Also the additional winch and power drive system formerly required for hoisting has been eliminated, without increasing non-drilling time.

Auxiliary equipment such as a centralizer and a breakout wrench can be added to the module, but are not necessary for an understanding of the invention.

Many modifications and variations will occur to those skilled in the art, and the invention is not limited in scope except as claimed.

What is claimed is:

1. In combination, a pulldown-pullback and hoisting system for an earthdrilling rig comprising:

a derrick adapted to be pivotably mounted to a vehicle for movement between a generally horizontal transporting position and a generally vertical drilling position;

a tophead-drive drill assembly slidably mounted on said derrick for rectilinear movement therealong;

a hoist assembly adapted to be extended upward from the derrick; and a hydraulically actuated, telescoping piston and cylinder assembly adapted to be altenately anchored to the derrick such that when said piston is anchored to said derrick and hydraulically actuated said hoise assembly is extended upward from said derrick by the movement of said cylinder and when said cylinder is anchored to said derrick and hydraulically actuated said tophead-drive drill assembly is provided pulldown and pullback pressure for rectilinear movement along said derrick.

2. An earthdrilling module comprising:

a derrick having an extendable top portion;

tophead-drive drill means slidably mounted on and linearly moveable along said derrick;

hoist means disposed on the extendable top portion of said derrick;

telescoping means on said derrick for moving said tophead-drive drill means along said derrick and for extending said top portion of said derrick; and said telescopic means is adapted for hydraulic actuation in two directions, wherein said telescopic means comprise:

a double-acting piston and cylinder assembly having a cylinder member movable in one direction and a piston rod member movable in an opposite direction;

one member abutting said hoist means and the other member imparting movement to said tophead-drive drill means; and locking means associated with said derrick for alternately locking one of said piston-cylinder members to said derrick so as to allow only the other member to move when said piston-cylinder assembly is hydraulically actuated.

* * * * *